US012590342B2

(12) United States Patent
Sato et al.

(10) Patent No.: US 12,590,342 B2
(45) Date of Patent: Mar. 31, 2026

(54) HOT-PRESSED MEMBER, COATED MEMBER, STEEL SHEET FOR HOT PRESSING, METHOD FOR MANUFACTURING HOT-PRESSED MEMBER, AND METHOD FOR MANUFACTURING COATED MEMBER

(71) Applicant: JFE Steel Corporation, Tokyo (JP)

(72) Inventors: Rinta Sato, Tokyo (JP); Daisuke Mizuno, Tokyo (JP); Minoru Tanaka, Tokyo (JP); Ryoto Nishiike, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 0 days.

(21) Appl. No.: 18/272,628

(22) PCT Filed: Oct. 22, 2021

(86) PCT No.: PCT/JP2021/039089
§ 371 (c)(1),
(2) Date: Jul. 17, 2023

(87) PCT Pub. No.: WO2022/158062
PCT Pub. Date: Jul. 28, 2022

(65) Prior Publication Data

US 2024/0076757 A1 Mar. 7, 2024

(30) Foreign Application Priority Data

Jan. 22, 2021 (JP) ..... 2021-008412

(51) Int. Cl.

| | |
|---|---|
| ***B32B 15/01*** | (2006.01) |
| ***C21D 1/18*** | (2006.01) |
| ***C21D 8/0221*** | (2026.01) |
| ***C21D 9/46*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/26*** | (2006.01) |
| ***C22C 38/28*** | (2006.01) |
| ***C22C 38/32*** | (2006.01) |
| ***C22C 38/60*** | (2006.01) |
| ***C23C 2/06*** | (2006.01) |
| ***C23C 2/12*** | (2006.01) |
| ***C23C 2/40*** | (2006.01) |
| ***C25D 3/56*** | (2006.01) |

(52) U.S. Cl.
CPC ..... *C21D 1/18* (2013.01); *C21D 8/0236* (2013.01); *C21D 9/46* (2013.01); *C22C 38/001* (2013.01); *C22C 38/002* (2013.01); *C22C 38/02* (2013.01); *C22C 38/04* (2013.01); *C22C 38/06* (2013.01); *C22C 38/26* (2013.01); *C22C 38/28* (2013.01); *C22C 38/32* (2013.01); *C22C 38/60* (2013.01); *C23C 2/06* (2013.01); *C23C 2/12* (2013.01); *C23C 2/40* (2013.01); *C25D 3/565* (2013.01)

(58) Field of Classification Search
None
See application file for complete search history.

(56) References Cited

U.S. PATENT DOCUMENTS

| | | | | |
|---|---|---|---|---|
| 6,296,805 | B1 | 10/2001 | Laurent et al. | |
| 7,534,502 | B2 * | 5/2009 | Honda | C23C 2/26 428/659 |
| 9,284,655 | B2 | 3/2016 | Kuhn et al. | |
| 2018/0135155 | A1 | 5/2018 | Suwa et al. | |
| 2018/0345339 | A1 | 12/2018 | Jeon et al. | |

FOREIGN PATENT DOCUMENTS

| | | | | |
|---|---|---|---|---|
| CN | 1984732 | | * | 6/2007 |
| CN | 101253001 | A | | 8/2008 |
| EP | 1 466 994 | A1 | | 10/2004 |
| EP | 1 930 088 | A1 | | 6/2008 |
| JP | S63-299802 | A | | 12/1988 |
| JP | H04-285149 | A | | 10/1992 |
| JP | H05-247668 | A | | 9/1993 |
| JP | H11-200000 | A | | 7/1999 |
| JP | 2000038640 | A | | 2/2000 |
| JP | 2003183801 | A | * | 7/2003 |
| JP | 2006-265614 | A | | 10/2006 |
| JP | 2012-041610 | A | | 3/2012 |
| JP | 4889212 | B2 | | 3/2012 |
| JP | 2013503254 | A | | 1/2013 |
| JP | 2014014834 | A | | 1/2014 |
| JP | 2020041175 | A | | 3/2020 |
| JP | 2020180312 | A | | 11/2020 |
| WO | 2016163467 | A1 | | 10/2016 |

OTHER PUBLICATIONS

International Search Report and Written Opinion for International Application No. PCT/JP2021/039089, dated Jan. 11, 2022, 5 pages.
Taylor et al., "Critical Review of Automotive Hot-Stamped Sheet Steel from an Industrial Perspective", Materials Science and Technology, (Jan. 2018), vol. 34, No. 7, pp. 809-861.
The Extended European Search Report issued Jul. 17, 2024, by the European Patent Office in corresponding European Patent Application No. 21921165.3-1103. (12 pages).
Office Action (Request for the Submission of an Opinion) issued Aug. 1, 2025, by the Korean Intellectual Property Office in corresponding Korean Patent Application No. 10-2023-7024364 and an English translation with the Concise Statement of Relevance of the Office Action. (12 pages).

(Continued)

*Primary Examiner* — Daniel J. Schleis
(74) *Attorney, Agent, or Firm* — Buchanan Ingersoll & Rooney PC

(57) ABSTRACT

A hot-pressed member is disclosed including at least one surface that has a filtered centerline waviness Wca of less than or equal to 1.5 μm.

6 Claims, No Drawings

(56) References Cited

OTHER PUBLICATIONS

Office Action (The First Office Action) issued Dec. 29, 2025, by the State Intellectual Property Office of People's Republic of China in corresponding Chinese Patent Application No. 202180090879.1 and an English translation with Concise explanation of relevance of the Office Action. (20 pages).
Office Action (Notice of Final Rejection) issued Jan. 1, 2026, by the Korean Intellectual Property Office in corresponding Korean Patent Application No. 10-2023-7024364 and an English translation with the Concise Statement of Relevance of the Office Action. (8 pages).

* cited by examiner

HOT-PRESSED MEMBER, COATED MEMBER, STEEL SHEET FOR HOT PRESSING, METHOD FOR MANUFACTURING HOT-PRESSED MEMBER, AND METHOD FOR MANUFACTURING COATED MEMBER

CROSS REFERENCE TO RELATED APPLICATIONS

This is the U.S. National Phase application of PCT/JP2021/039089, filed Oct. 22, 2021, which claims priority to Japanese Patent Application No. 2021-008412, filed Jan. 22, 2021, the disclosures of these applications being incorporated herein by reference in their entireties for all purposes.

FIELD OF THE INVENTION

The present invention relates to a hot-pressed member, a coated member, a steel sheet for hot pressing, a method for manufacturing a hot-pressed member, and a method for manufacturing a coated member. In particular, aspects of the present invention relate to a hot-pressed member, a coated member, and a steel sheet for hot pressing that have excellent post-coating image clarity and post-coating corrosion resistance and also relate to a method for manufacturing such a hot-pressed member and to a method for manufacturing such a coated member.

BACKGROUND OF THE INVENTION

In the field of automobiles, there has been a trend toward reducing the weight of material steel sheets as well as enhancing their performance. Accordingly, the use of a high-strength corrosion-resistant hot-dip galvanized steel sheet or a high-strength corrosion-resistant electrogalvanized steel sheet has been increasing. However, in many instances, when steel sheets have increased strength, they have reduced press formability, which makes it difficult to achieve complex shapes of parts. Regarding automotive applications, examples of parts that need to be corrosion-resistant and are difficult to form include structural frame components, such as a side sill.

Under these circumstances, the use of hot pressing for the manufacture of automotive parts has been rapidly increasing in recent years because both press formability and increased strength can be easily achieved in the case of hot pressing, compared with cold pressing. Accordingly, various technologies for solving problems associated with hot pressing techniques have been disclosed.

For example, Patent Literature 1 discloses Al- or Al alloy-plated steel sheets (hot rolled steel sheet and cold rolled steel sheet) for hot pressing, which, after being hot-pressed, can exhibit high strength and excellent corrosion resistance.

Furthermore, Patent Literature 2 discloses a hot-pressed member including an α-Fe (Zn, Ni) mixed crystal, an intermetallic compound of Zn, Ni, and Fe, and a Mn-containing layer.

PATENT LITERATURE

PTL 1: Japanese Unexamined Patent Application Publication No. 2000-38640

PTL 2: Japanese Unexamined Patent Application Publication (Translation of PCT Application) No. 2013-503254

SUMMARY OF THE INVENTION

Another property required in automotive structural members is aesthetic pleasantness of the appearance of the coated surface (post-coating image clarity). However, when steel materials have increased strength, the roughness of their surfaces is difficult to correct. The related art has used a technique of disposing a panel member having low strength and excellent appearance quality on an outer surface of a high-strength frame component, to achieve both strength and the appearance quality. If the surface appearance of structural frame components can be improved, the panel member can be omitted, and consequently, a drastic weight reduction can be achieved.

The hot-pressed members disclosed in Patent Literature 1 and Patent Literature 2 are both hot-pressed members manufactured by heating a plated steel sheet and have excellent post-coating corrosion resistance. However, neither Patent Literature 1 nor Patent Literature 2 addresses post-coating image clarity.

Aspects of the present invention have been made in view of the problem described above, and objects of aspects of the present invention are to provide a hot-pressed member and a coated member that have excellent post-coating image clarity and post-coating corrosion resistance and to provide methods for manufacturing the same. Another object is to provide a steel sheet for hot pressing suitable for hot-pressed members having excellent post-coating image clarity and post-coating corrosion resistance.

The present inventors diligently conducted studies to achieve the objects and made the following findings.

(1) An effective way to improve the post-coating image clarity of a hot-pressed member is as follows: a surface thereof is configured to have a filtered centerline waviness Wca of less than or equal to 1.5 μm. Furthermore, the surface may be configured to have a line roughness Ra of less than or equal to 2.0 μm and a skewness Rsk of less than or equal to 0. In this case, further improvement in the post-coating image clarity can be expected.

(2) In an instance where a steel sheet for hot pressing, before being subjected to hot pressing, is configured to have a filtered centerline waviness Wca of less than or equal to 0.75 μm, the filtered centerline waviness Wca, after hot pressing, can be less than or equal to 1.5 μm.

Aspects of the present invention are based on the findings described above, and features thereof are as follows.

[1] A hot-pressed member including at least one surface that has a filtered centerline waviness Wca of less than or equal to 1.5 μm.

[2] The hot-pressed member according to [1], wherein the at least one surface has a line roughness Ra of less than or equal to 2.0 μm and a skewness Rsk of less than or equal to 0.

[3] The hot-pressed member according to [1] or [2], further including a plated layer disposed on the at least one surface, the plated layer containing at least one selected from Al, Zn, and Fe and having a thickness of 10 to 80 μm, wherein the filtered centerline waviness Wca is less than or equal to 1.5 μm.

[4] A coated member including a base member that includes the hot-pressed member according to any one of [1] to [3]; and a coating layer disposed on at least one surface of the base member and having a thickness of greater than or equal to 15 μm.

[5] A steel sheet for hot pressing including at least one surface that has a filtered centerline waviness Wca of less than or equal to 0.75 μm.

[6] The steel sheet for hot pressing according to [5], wherein the at least one surface has a line roughness Ra of less than or equal to 1.0 μm and a crack density per unit cross-sectional length of greater than or equal to 30 cracks/mm, the crack density being a crack density in a cross section with a length of 1 mm of the at least one surface.

[7] The steel sheet for hot pressing according to [5] or [6], further including a plated layer disposed on the at least one surface, the plated layer containing at least one selected from Al, Zn, and Fe and having a thickness of 3 to 30 μm.

[8] A method for manufacturing a hot-pressed member including heating a steel sheet for hot pressing to a temperature range of an $Ac_3$ transformation temperature to 1000° C., the steel sheet for hot pressing having at least one surface that has a filtered centerline waviness Wca of less than or equal to 0.75 μm; and subsequently hot-pressing the steel sheet for hot pressing.

[9] A method for manufacturing a coated member including heating a steel sheet for hot pressing to a temperature range of an $Ac_3$ transformation temperature to 1000° C., the steel sheet for hot pressing having at least one surface that has a filtered centerline waviness Wca of less than or equal to 0.75 μm; hot-pressing the steel sheet for hot pressing; and subsequently providing a coating layer having a thickness of greater than or equal to 15 μm.

Aspects of the present invention can provide a hot-pressed member having excellent post-coating image clarity and post-coating corrosion resistance. In instances where the hot-pressed member is used as a base member, and a coating is applied thereto, the resulting coated member has excellent post-coating image clarity and is, therefore, suitable for an automotive exterior panel component. Furthermore, aspects of the present invention can provide a steel sheet for hot pressing suitable for a hot-pressed member having excellent post-coating image clarity and post-coating corrosion resistance.

DETAILED DESCRIPTION OF EMBODIMENTS OF THE INVENTION

The present inventors diligently performed studies regarding techniques for improving the appearance quality of coatings of hot-pressed members. As a result, it was found out that the post-coating image clarity of hot-pressed members is closely related to a surface roughness of the hot-pressed members and that the surface roughness of hot-pressed members is closely related to the surface roughness and a state of division of the surface, of the steel sheets for hot pressing. Furthermore, when steel sheets for hot pressing have an Al- or Zn-based coating applied thereto, resulting hot-pressed members have excellent post-coating corrosion resistance.

Embodiments of the present invention will be described below. Note that the following description describes preferred embodiments of the present invention, and, therefore, the following description is in no way intended to be limiting. Furthermore, regarding the chemical composition of steel, the contents of elements are all in mass %; hereinafter, the contents are expressed simply in % unless otherwise specified. Furthermore, the definitions of surface geometric shapes (a filtered centerline waviness Wca, a line roughness Ra, and a skewness Rsk) and cut-off values are in accordance with JIS B 0601 (2001).

1) Hot-Pressed Member

First, the surface geometric shapes of a hot-pressed member according to aspects of the present invention will be described. The hot-pressed member according to aspects of the present invention includes at least one surface that has a filtered centerline waviness Wca of less than or equal to 1.5 μm. The Wca which corresponds to long-wavelength irregularities remains even after a thick coating is applied, and, therefore, directly affects the post-coating appearance quality. Accordingly, the Wca has a significant influence on the image clarity compared to various other geometric parameters. In the instance where the Wca is reduced, a thickness of a coating necessary to obtain predetermined appearance properties can be reduced. Also, for coatings having a certain thickness, it is possible to improve the quality of the post-coating appearance. The filtered centerline waviness Wca is preferably less than or equal to 1.4 μm and more preferably less than or equal to 1.3 μm. Regarding the lower limit, it is preferable that the Wca be greater than or equal to 0.1 μm because achieving a Wca of less than 0.1 μm requires a very high degree of refining of grains and, therefore, increases costs.

In the hot-pressed member according to aspects of the present invention, it is desirable that the surface having a filtered centerline waviness Wca of less than or equal to 1.5 μm have a line roughness Ra of less than or equal to 2.0 μm and a skewness Rsk of less than or equal to 0. The Ra which corresponds to short-wavelength irregularities becomes buried in a coating, and, therefore, has a less significant influence than the Wca. However, from the standpoint of achieving enhanced post-coating image clarity, it is desirable to reduce the Ra. The Ra is preferably less than or equal to 1.8 μm, more preferably less than or equal to 1.5 μm, and most preferably less than or equal to 1.0 μm. Regarding the lower limit, it is preferable that the Ra be greater than or equal to 0.2 μm because when the Ra is less than 0.2 μm, surface flaws become more visible, and, therefore, surface quality may be impaired.

The skewness Rsk is a ratio that is a roughness shape factor representing a size and a shape of the peaks and valleys of microscopic irregularities (roughness). Specifically, the ratio is a ratio between a height of the peaks and a depth of the valleys (height of peaks/depth of valleys). Accordingly, when the value has a positive (+) value, the height of the peaks is greater than the depth of the valleys, and when the value has a negative (−) value, the height of the peaks is less than the depth of the valleys. When the Rsk is a negative value, excellent coating quality with a high gloss level can be achieved. This is believed to be because when the Rsk is a negative value, many of the peak portions are flat, which results in a higher proportion of specular reflection. Accordingly, it is desirable that the skewness Rsk be less than or equal to 0. The skewness Rsk is more preferably less than or equal to −0.3 and even more preferably less than or equal to −0.5. Regarding the lower limit, it is preferable that the Rsk be greater than or equal to −1.0.

It is preferable that the hot-pressed member according to aspects of the present invention have a plated layer disposed on the surface having a filtered centerline waviness Wca of less than or equal to 1.5 μm and that the plated layer contain at least one selected from Al, Zn, and Fe and have a thickness of 10 μm to 80 μm. Note that in the hot-pressed member according to aspects of the present invention, at least one surface has a filtered centerline waviness Wca of less than or equal to 1.5 μm regardless of the presence or absence of the plating thereon, and it is desirable that the surface have a line roughness Ra of less than or equal to 2.0 μm and a skewness Rsk of less than or equal to 0.

When the hot-pressed member has a plated layer on the surface, a rate of corrosion (cosmetic corrosion) at sites having reduced corrosion protection ability of a coating, such as flawed portions of the coating and edge portions of the coating, is reduced, and, consequently, excellent coating appearance can be maintained for a long time. Furthermore, the rate of crevice corrosion (overlapping portion corrosion) at an overlapping portion, which cannot be sufficiently covered by a coating, is also reduced, and, consequently, perforation corrosion life of the member can be extended.

The plated layer containing at least one selected from Al, Zn, and Fe may be, for example, an Al-based plated layer or a Zn-based plated layer. An example of the Al-based plated layer is one that contains Fe: 10 to 90%, Si: 1 to 15%, Mg: 0 to 10% (0 is inclusive), Ca: 0 to 10% (0 is inclusive), and Zn: 0 to 50% (0 is inclusive), with the balance being Al and incidental impurities. An example of the Zn-based plated layer is one that contains Fe: 10 to 90%, Al: 0 to 20% (0 is inclusive), Mg: 0 to 10% (0 is inclusive), Ca: 0 to 10% (0 is inclusive), Ni: 0 to 30% (0 is inclusive), Co: 0 to 30% (0 is inclusive), Mn: 0 to 30% (0 is inclusive), and Cr: 0 to 30% (0 is inclusive), with the balance being Zn and incidental impurities.

Regarding the thickness of the plated layer, it is preferable, from the standpoint of ensuring sufficient corrosion resistance, that the plated layer have a thickness of greater than or equal to 10 μm. More preferably, the thickness of the plated layer is greater than or equal to 20 μm. On the other hand, even if the thickness is excessively increased, the corrosion-resistance-improving effect no longer increases, while manufacturing costs are increased. Accordingly, the thickness of the plated layer is preferably less than or equal to 80 μm. The thickness of the plated layer is more preferably less than or equal to 50 μm and even more preferably less than or equal to 30 μm.

2) Coated Member

A coated member according to aspects of the present invention includes a base member, and the base member is the above-described hot-pressed member. The coated member includes a coating layer disposed on at least one surface and having a thickness of greater than or equal to 15 μm. The surface on which the coating layer is formed is the surface of the hot-pressed member having a filtered centerline waviness Wca of less than or equal to 1.5 μm. In the instance where the plated layer is present, the coating layer is formed on the plated layer of the hot-pressed member or on a chemical conversion coating thereof. In the instance where no plated layer is present, the coating layer is formed on the hot-pressed member or on a chemical conversion coating. When the coating layer is thick, the appearance quality can be enhanced. The thickness of the coating layer is preferably greater than or equal to 40 μm in total for one surface and even more preferably greater than or equal to 80 μm in total. Even if the thickness of the coating layer is excessively increased, the appearance-improving effect no longer increases, while costs are increased. Accordingly, the thickness of the coating layer is preferably less than or equal to 150 μm in total and more preferably less than or equal to 120 μm in total.

Examples of a resin that is included in the coating layer include epoxy resins, melamine resins, acrylic resins, alkyd resins, polyester resins, and urethane resins. The resin may be a composite resin of any of these. The coating layer may be a single such layer or a plurality of such layers.

The thickness of the coating layer can be measured by observing a cross section of the coated member with an optical microscope or a scanning electron microscope (SEM). There are several types of methods for polishing a cross section and methods for etching a cross section. Any of the methods may be used as long as the methods are ones that are generally used for the observation of cross sections of steel sheets. Furthermore, regarding the conditions for the observation with a scanning electron microscope, an acceleration voltage of 15 kV and a magnification of 200 times or more for secondary electron images may be used, for example. In these cases, the coating can be clearly observed.

Optionally, a chemical conversion treatment, which is a pretreatment for the coating application, may be performed. In instances where a chemical conversion treatment is performed, improvement in adhesion between the base member and the coating can be expected. Examples of types of chemical conversion treatments include zinc phosphate-based chemical conversion treatments and zirconium oxide-based chemical conversion treatments.

3) Steel Sheet for Hot Pressing

A steel sheet for hot pressing according to aspects of the present invention includes at least one surface that has a filtered centerline waviness Wca of less than or equal to 0.75 μm. In instances where the steel sheet for hot pressing to be used has a plating, interdiffusion of a component in the plating and the Fe of the base steel occurs, which causes alloying to progress, and, consequently, after heating, a substantial thickness of the plating is greater than a pre-heating thickness of the plating. The studies conducted by the present inventors found that the increase in the thickness of the plating depends on a composition of the plating and that the resulting thickness is at most approximately three times greater. The studies also found that a distribution exists in a plane, with one or more regions substantially having no increase in the thickness, which, presumably, contributes to an increase in the waviness. In this instance, an unevenness corresponding to twice the original thickness is created between the regions having an increase in the plating thickness and the regions having an unchanged thickness. In the instance of un-plated steel sheets with no plated layer, when such steel sheets are subjected to a heat treatment, a scale develops on a surface thereof. A thickness of the scale depends on the heat treatment conditions, and, in some cases, a distribution exists in a plane. As a result, the waviness may increase compared with the pre-heat-treatment waviness. In accordance with aspects of the present invention, the steel sheet for hot pressing is configured to have a waviness of less than or equal to 0.75 μm, and, consequently, a post-hot-pressing waviness of less than or equal to 1.5 μm can be consistently achieved. It is preferable that the Wca of the steel sheet for hot pressing be less than or equal to 0.60 μm, from the standpoint of achieving enhanced post-heat-treatment and post-coating appearance. The Wca is more preferably less than or equal to 0.50 μm, even more preferably less than or equal to 0.30 μm, and most preferably less than or equal to 0.20 μm. Regarding the lower limit, it is preferable that the Wca be greater than or equal to 0.01 μm because achieving a Wca of less than 0.01 μm requires a very high degree of refining of grains and, therefore, increases costs.

Methods for controlling the waviness of the steel sheet for hot pressing are not particularly limited, and examples of the methods include a method in which rolls are adjusted for temper rolling of the steel sheet that may be performed after rolling or coating.

In the steel sheet for hot pressing according to aspects of the present invention, it is preferable that the surface having a filtered centerline waviness Wca of less than or equal to 0.75 μm have a line roughness Ra of less than or equal to 1.0 μm and a crack density per unit cross-sectional length of greater than or equal to 30 cracks/mm, the crack density being a crack density in a cross section with a length of 1 mm of the surface. As with the Wca, described above, the Ra increases to approximately twice the original value as a result of alloying associated with hot pressing. In the instance where the Ra of the steel sheet for hot pressing is less than or equal to 1.0 μm, a post-hot-pressing Ra of less than or equal to 2.0 μm can be consistently achieved. It is more preferable that the Ra of the steel sheet for hot pressing be less than or equal to 0.75 μm, from the standpoint of achieving enhanced post-heat-treatment and post-coating appearance. The Ra is even more preferably less than or equal to 0.5 μm and most preferably less than or equal to 0.3 μm. Methods for controlling the Ra of the steel sheet for hot pressing are not particularly limited, and examples of the methods include a method in which rolls are adjusted for temper rolling of the steel sheet that may be performed after rolling or plating.

In instances where cracks that reach an interface between the plated layer and the underlying steel substrate are provided in the surface of a plated steel sheet for hot pressing, an increase in Wca and Ra due to the unevenness associated with alloying can be inhibited, a post-heating Rsk can be reduced, and an area of the flat portion can be increased. It is preferable that a crack density per unit cross-sectional length in a cross section with a length of 1 mm be greater than or equal to 30 cracks/mm of the surface having a filtered centerline waviness Wca of less than or equal to 0.75 μm, so as to consistently achieve an Rsk that is a negative value. The crack density is more preferably greater than or equal to 50 cracks/mm, even more preferably greater than or equal to 70 cracks/mm, and most preferably greater than or equal to 80 cracks/mm. Regarding the upper limit, it is preferable that the crack density be less than or equal to 200 cracks/mm, because if the crack density is excessive, the plated layer undergoes significant oxidation in the heating step prior to hot pressing, which reduces the weldability and the like of the hot-pressed member. Methods for providing cracks in the surface of the steel sheet for hot pressing are not particularly limited, and examples of the methods include application of a tensile stress (tensile working), laser damaging, melting of grain boundaries with a chemical treatment, such as acid dipping.

In accordance with aspects of the present invention, the plating on the steel sheet for hot pressing is not a requisite, and, therefore, an un-plated steel sheet may be used in the case of the manufacture of a hot-pressed member that is to be applied to a portion that does not require corrosion resistance.

In the instance where the hot-pressed member is applied to a portion that requires corrosion resistance, it is desirable, from the standpoint of improving post-heating corrosion resistance, that a plated layer containing at least one selected from Al, Zn, and Fe be provided on the surface having a filtered centerline waviness Wca of less than or equal to 0.75 μm. The metal that forms the plated layer may be unalloyed zinc, unalloyed aluminum, alloyed zinc, alloyed aluminum, or such an alloy that further contains one or more other alloying elements. For example, one or more elements selected from Mg, Cr, Co, and Ni may be present in an amount of 0.1 to 20%. In this case, further improvement in corrosion resistance can be expected. Furthermore, the plated layer may be one in which an oxide is dispersed, which, for example, may be a plated layer including nanoparticles of $SiO_2$ or $Al_2O_3$ in an amount of 0.1 to 10%. A thickness of the plated layer is not limited, and it is preferable that the thickness be greater than or equal to 3 μm so that corrosion resistance can be exhibited after a heat treatment. The thickness is more preferably greater than or equal to 6 μm and even more preferably greater than or equal to 10 μm. It is preferable that the thickness of the plated layer be less than or equal to 30 μm so that the alloying can be completed in a hot stamping step. The thickness is more preferably less than or equal to 20 μm. Note that in the steel sheet for hot pressing according to aspects of the present invention, at least one surface has a filtered centerline waviness Wca of less than or equal to 0.75 μm regardless of the presence or absence of the coating thereon, and it is preferable that the surface have a line roughness Ra of less than or equal to 1.0 μm and a crack density per unit cross-sectional length of greater than or equal to 30 cracks/mm, the crack density being a crack density in a cross section with a length of 1 mm.

The plated layer according to aspects of the present invention may be a single layer of the plated layer or be provided with an underlying film or an overlying film, depending on a purpose, as long as the effects and advantages according to aspects of the present invention are not adversely affected. Examples of the underlying film include an underlying plated layer formed primarily of Ni.

In accordance with aspects of the present invention, the steel sheet for hot pressing may be one in which a steel sheet having a chemical composition is used, so that a hot-pressed member that has a strength greater than 1470 MPa after being hot-pressed can be produced. The chemical composition contains, for example, in mass %, C: 0.20 to 0.50%, Si: 0.1 to 0.5%, Mn: 0.5 to 3.0%, P: 0.1% or less, S: 0.01% or less, Al: 0.10% or less, and N: 0.01% or less, with the balance being Fe and incidental impurities. Note that the steel sheet may be a cold rolled steel sheet or a hot rolled steel sheet. Reasons for the limitations on each of the components will be described below.

C: 0.20 to 0.50%

C improves strength by enabling the formation of steel microstructures, such as martensite. An amount of C of greater than or equal to 0.20% is necessary for achieving a strength greater than 1470 MPa. Accordingly, it is preferable that a C content be greater than or equal to 0.20%. More preferably, the C content is greater than or equal to 0.22%. On the other hand, if the C content is greater than 0.50%, the toughness of a spot weld is reduced. Accordingly, it is preferable that the C content be less than or equal to 0.50%. The C content is more preferably less than or equal to 0.45%, even more preferably less than or equal to 0.43%, and most preferably less than or equal to 0.40%.

Si: 0.1 to 0.5%

Si is an element effective for strengthening steel, thereby producing a favorable material quality. For this purpose, a Si content of greater than or equal to 0.1% is necessary. Accordingly, it is preferable that the Si content be greater than or equal to 0.1%. More preferably, the Si content is greater than or equal to 0.2%. On the other hand, if the Si content is greater than 0.5%, ferrite is stabilized, which reduces hardenability. Accordingly, it is preferable that the Si content be less than or equal to 0.5%. The Si content is more preferably less than or equal to 0.4% and even more preferably less than or equal to 0.3%.

Mn: 0.5 to 3.0%

Mn is an element effective for ensuring a post-cooling strength for a wide cooling rate range. Mn needs to be present in an amount greater than or equal to 0.5% so as to ensure mechanical properties and the strength. Accordingly, it is preferable that a Mn content be greater than or equal to 0.5%. The Mn content is more preferably greater than or equal to 0.7% and even more preferably greater than or equal to 1.0%. On the other hand, if the Mn content is greater than 3.0%, costs increase, and in addition, the effects no longer increase. Accordingly, it is preferable that the Mn content be less than or equal to 3.0%. The Mn content is more preferably less than or equal to 2.5%, even more preferably less than or equal to 2.0%, and most preferably less than or equal to 1.5%.

P: 0.1% or Less

If a P content is greater than 0.1%, P segregation at austenite grain boundaries during casting causes intergranular embrittlement, which results in degradation in local ductility, and, consequently, a balance between the strength and the ductility is reduced. Accordingly, it is preferable that the P content be less than or equal to 0.1%. Furthermore, from the standpoint of the cost of steelmaking, it is preferable that the P content be greater than or equal to 0.01%.

S: 0.01% or Less

S forms inclusions, such as MnS, which can cause degradation in impact resistance and cause cracking along a metal flow in a weld. Accordingly, it is desirable that S be reduced as much as possible; preferably, S is present in an amount less than or equal to 0.01%. Furthermore, it is more preferable that the amount be less than or equal to 0.005% so as to ensure good stretch flangeability. Even more preferably, the amount is less than or equal to 0.001%. Regarding the lower limit, it is preferable, from the standpoint of the cost of steelmaking, that the amount be greater than or equal to 0.0002%.

Al: 0.10% or Less

If an Al content is greater than 0.1%, the blanking workability and the hardenability of the material steel sheet are reduced. Accordingly, it is preferable that the Al content be less than or equal to 0.10%. The Al content is more preferably less than or equal to 0.07% and even more preferably less than or equal to 0.04%. Regarding the lower limit, it is preferable, from the standpoint of ensuring the effect of serving as a deoxidizing agent, that the Al content be greater than or equal to 0.01%.

N: 0.01% or Less

If a N content is greater than 0.01%, a nitride of Al is formed during hot rolling and/or the heating prior to hot pressing, and, consequently, the blanking workability and the hardenability of the material steel sheet are reduced. Accordingly, it is preferable that the N content be less than or equal to 0.01%. From the standpoint of the cost of steelmaking, it is preferable that the N content be greater than or equal to 0.001%.

Furthermore, in accordance with aspects of the present invention, at least one selected from Nb: 0.10% or less, Ti: 0.05% or less, B: 0.0002 to 0.005%, Cr: 0.1 to 0.3%, and Sb: 0.003 to 0.03% may be appropriately included, as necessary, in addition to the fundamental components described above, to further improve the properties of the steel sheet.

Nb: 0.10% or Less

Nb is a component effective for strengthening steel, but including an excessive amount of Nb increases a rolling load. Accordingly, in instances where Nb is to be included, a Nb content is specified to be less than or equal to 0.10%. The Nb content is preferably less than or equal to 0.05%. Regarding the lower limit, it is preferable, from the standpoint of the cost of steelmaking, that the content be greater than or equal to 0.005%.

Ti: 0.05% or Less

Similar to Nb, Ti is effective for strengthening steel but presents a problem in that including an excessive amount of Ti reduces shape fixability. Accordingly, in instances where Ti is to be included, a Ti content is specified to be less than or equal to 0.05%. The Ti content is preferably less than or equal to 0.03%. Regarding the lower limit, it is preferable, from the standpoint of the cost of steelmaking, that the content be greater than or equal to 0.003%.

B: 0.0002 to 0.005%

B has an effect of inhibiting the formation and growth of ferrite from the austenite grain boundaries. It is, therefore, preferable that B be present in an amount greater than or equal to 0.0002%. Accordingly, in instances where B is to be included, it is preferable that a B content be greater than or equal to 0.0002%. The B content is more preferably greater than or equal to 0.0010%. On the other hand, including an excessive amount of B significantly impairs formability. Accordingly, in instances where B is to be included, the B content is specified to be less than or equal to 0.005%. The B content is preferably less than or equal to 0.003%.

Cr: 0.1 to 0.3%

Cr is useful for strengthening steel and improving hardenability. It is preferable that Cr be present in an amount greater than or equal to 0.1% so as to produce the effects. Accordingly, in instances where Cr is to be included, a Cr content is specified to be greater than or equal to 0.1%. The Cr content is preferably greater than or equal to 0.2%. On the other hand, including Cr in an amount greater than 0.3% significantly increases costs because the alloying cost is high. Accordingly, in instances where Cr is to be included, the amount is specified to be less than or equal to 0.3%. The amount is preferably less than or equal to 0.2%.

Sb: 0.003 to 0.03%

Sb has an effect of inhibiting, in an annealing process for the substrate sheet that is to be plated, decarburization in a surface layer of the steel sheet. Producing this effect requires that Sb be included in an amount greater than or equal to 0.003%. Accordingly, in instances where Sb is to be included, an Sb content is specified to be greater than or equal to 0.003%. The Sb content is preferably greater than or equal to 0.005%. On the other hand, if the Sb content is greater than 0.03%, an increase in the rolling load occurs, which reduces productivity. Accordingly, in instances where Sb is to be included, the Sb content is specified to be less than or equal to 0.03%. The Sb content is preferably less than or equal to 0.02% and more preferably less than or equal to 0.01%.

The balance, other than the components described above, is Fe and incidental impurities.

Preferably, the hot-pressed member has a tensile strength of greater than 1320 MPa. The tensile strength is more preferably greater than 1400 MPa and even more preferably greater than 1470 MPa.

3) Method for Manufacturing Steel Sheet for Hot Pressing

The manufacturing conditions for the steel sheet according to aspects of the present invention are not particularly limited; described below are desirable manufacturing conditions. A steel having the components described above is cast, and the resulting hot slab is subjected to hot rolling directly or after being heated, or after the slab that has been cooled is reheated. In this regard, there is substantially no difference between the properties resulting from the hot direct rolling of the hot slab and the properties resulting from the rolling after reheating. Furthermore, a temperature for the reheating is not particularly limited and may be within a range of 1000° C. to 1300° C., which is preferable in terms of productivity. The hot rolling may employ a typical hot rolling process or a continuous hot rolling process in which finish rolling is carried out by rolling joined slabs. For the hot rolling, it is desirable, in terms of productivity and gauge accuracy, that a finish rolling temperature be greater than or equal to an $Ar_3$ transformation temperature. After the hot rolling, cooling is performed in a typical manner. In this regard, it is preferable that a coiling temperature be greater than or equal to 550° C., from the standpoint of productivity. Furthermore, if the coiling temperature is excessively high, pickling properties are degraded, and, therefore, it is desirable that the coiling temperature be less than or equal to 750° C. For pickling and cold rolling, any known method may be used.

A plating that may be subsequently applied may be applied with any method; the method is appropriately selected in accordance with the alloy system. In the instance of an unalloyed zinc or zinc-nickel alloy plating, the application may be preferably performed by electroplating. In the instance of a zinc-aluminum alloy plating, the application may be preferably performed by hot-dip coating. In the instance of a zinc-magnesium alloy coating, the application may be preferably performed by vacuum vapor deposition. In the instance of an Al—Si-based plating, the application may be preferably performed by hot-dip plating. Furthermore, an alloying treatment may be performed after the application of the plating, and in this case, a plating alloyed with iron can be efficiently produced. Regarding an atmosphere for the plating process, typical conditions can be used for the application of the plating, either in the case of using a continuous coating line including a non-oxidizing furnace or a continuous coating line including no non-oxidizing furnace. No special control exclusively for the present steel sheet is necessary, and, therefore, productivity is not impaired.

4) Method for Manufacturing Hot-Pressed Member

In accordance with aspects of the present invention, a hot-pressed member having excellent image clarity after coating can be produced as follows: a steel sheet for hot pressing having a filtered centerline waviness Wca of less than or equal to 0.75 μm is heated to a temperature range of an $Ac_3$ transformation temperature to 1000° C. and subsequently hot-pressed.

If the heating temperature for heating the steel sheet for hot pressing is less than the $Ac_3$ transformation temperature, a strength necessary for hot-pressed members may not be achieved. Accordingly, the heating temperature is specified to be greater than or equal to the $Ac_3$ transformation temperature. Preferably, the heating temperature is greater than or equal to 860° C. If the heating temperature is greater than 1000° C., an oxide film that results from oxidation of the base steel and/or the plated layer may be an excessively thick film, and, consequently, adhesion of the coating material on the resulting hot-pressed member may be low. Accordingly, the heating temperature is specified to be less than or equal to 1000° C. The heating temperature is preferably less than or equal to 950° C. and more preferably less than or equal to 900° C. A heating rate is preferably 3° C./s or greater and 300° C./s or less. If the heating rate is less than 3° C./s, exposure to high temperatures lasts for an excessively long time; as a result, an oxide film that results from oxidation of the base steel and/or the plated layer may be an excessively thick film, and, consequently, adhesion of the coating material on the resulting hot-pressed member may be low. Accordingly, the heating rate is preferably greater than or equal to 3° C./s, more preferably greater than or equal to 10° C./s, and even more preferably greater than or equal to 50° C./s. If the heating rate is greater than 300° C./s, the plated layer may melt during the heating, and as a result, a heating device and/or a die assembly may be fouled. Accordingly, the heating rate is preferably less than or equal to 300° C./s, more preferably less than or equal to 250° C./s, and even more preferably less than or equal to 200° C./s.

Furthermore, a holding time associated with the heating temperature is in no way limited. It is preferable that the holding time be less than or equal to 5 minutes, from the standpoint of enabling as much as possible of an intermetallic compound phase to remain, thereby further improving the post-coating corrosion resistance and from the standpoint of avoiding absorption of hydrogen that may be caused if water vapor present in the furnace is taken up during the holding time. The holding time is more preferably less than or equal to 3 minutes and even more preferably less than or equal to 1 minute. Regarding the lower limit, it is preferable that the holding time be greater than or equal to 10 s so that the steel sheet for hot pressing can be uniformly austenitized.

Furthermore, methods for heating the steel sheet for hot pressing are in no way limited. Examples of the methods include furnace heating that uses an electric furnace or a gas furnace, Joule heating, induction heating, RF heating, and flame heating.

After the heating, a hot-pressing process is performed, and, simultaneously with or immediately after the process, cooling is performed in a die assembly or with a coolant, such as water. In this manner, the hot-pressed member is manufactured. In accordance with aspects of the present invention, the conditions for the hot pressing are not particularly limited. The pressing may be performed at a temperature of 600 to 800° C., which is a typical temperature range for hot pressing.

5) Method for Manufacturing Coated Member

In accordance with aspects of the present invention, a coated member having excellent appearance quality can be manufactured as follows: a coated steel sheet for hot pressing including at least one surface that has a filtered centerline waviness Wca of less than or equal to 0.75 μm is heated to a temperature range of an $Ac_3$ transformation temperature to 1000° C. and then hot-pressed, and subsequently, a coating layer having a thickness of greater than or equal to 15 μm is provided. Methods for the coating application are not limited, and an appropriate method may be selected in accordance with the type of the coating material that is used. Examples of the methods include cationic electrodeposition coating, electrostatic coating, and spray coating.

Example 1

Aspects of the present invention will now be described in detail with reference to examples. The examples described below are not intended to limit the present invention. Making appropriate modifications within the scope of the primary features is encompassed by the scope of the present invention.

The base steel sheet used was a cold rolled steel sheet having a sheet thickness of 1.4 mm ($Ac_3$ transformation temperature=848° C.). The base steel sheet had a chemical composition containing, in mass %, C: 0.24%, Si: 0.25%, Mn: 1.28%, P: 0.005%, S: 0.001%, Al: 0.03%, N: 0.004%, Nb: 0.02%, Ti: 0.02%, B: 0.002%, Cr: 0.2%, and Sb: 0.008%, with the balance being Fe and incidental impurities.

An Al-based plating was applied to the base steel sheet by hot-dip plating as described below. Furthermore, a Zn-based plating was applied by hot-dip plating or electroplating as described below. Furthermore, un-plated steel sheets, which were steel sheets for hot pressing on which no plating treatment was performed, were also prepared (Level Nos. 23 and 24).

<Hot-Dip Plating>

Plated steel sheets for hot pressing of Level Nos. 1 to 7 and Nos. 13 to 18, shown in Table 1, were prepared as follows: the cold rolled steel sheet was immersed in a hot-dip Al—Si-based plating bath or a hot-dip Zn—Al plating bath, in a hot-dip plating line, and subsequently, $N_2$ gas wiping was performed thereon. Furthermore, coated steel sheets for hot pressing of Level Nos. 8 to 12, shown in Table 1, were prepared as follows: the cold rolled steel sheet was immersed in a hot-dip Zn plating bath in a hot-dip plating line, subsequently, $N_2$ gas wiping was performed thereon, and subsequently, an alloying treatment was performed thereon in a Joule heating furnace. After the hot-dip plating or the alloying treatment, temper rolling was performed with rolls having different surface roughnesses. In this manner, the Wca and the Ra were varied.

<Electroplating>

First, temper rolling was performed on the substrate sheet with rolls having different surface roughnesses. In this manner, the Wca and the Ra were varied. Subsequently, a Zn—Ni-based alloy plated layer having a Ni content of 12% was formed with an electroplating treatment, to prepare plated steel sheets for hot pressing of Level Nos. 19 to 22, shown in Table 1. The electroplating treatment was performed in a plating bath (a pH of 1.4 and a bath temperature of 50° C.), which included 115 g/L of zinc sulfate heptahydrate, 230 g/L of nickel sulfate hexahydrate, and 55 g/L of sodium sulfate, with the current density being varied from 10 to 100 A/dm$^2$ and the electroplating time from 5 to 60 seconds.

<Introduction of Cracks and Determination of Crack Density>

For some of the Levels, cracks were introduced into the surface of the coated steel sheets by tensile working or dipping in an acidic solution. The tensile working was carried out by performing, on the steel sheets for hot pressing, uniaxial tensile working in a rolling direction at an elongation rate of 5%. The dipping in an acidic solution was carried out by dipping the plated steel sheets in an aqueous solution with a pH of 1.4 and a bath temperature of 50° C. for 40 seconds. The aqueous solution included 115 g/L of zinc sulfate heptahydrate, 230 g/L of nickel sulfate hexahydrate, and 55 g/L of sodium sulfate. After the crack introduction treatment was performed, the surface of the steel sheets for hot pressing was observed to measure the crack density. Specifically, the surface of the steel sheets for hot pressing was observed with a scanning electron microscope (SEM) at a magnification of 1000×, three straight lines were arbitrarily drawn, the points of intersection with cracks were counted, and the number of the points was divided by a length of the straight lines to give the crack density per unit length (cracks/mm). In this instance, the surface observation was performed in three fields of view for each of the samples so that the measurement accuracy for the crack density could be increased, and an average of the results was employed as the crack density. The method for the introduction of cracks and the crack number density are shown in Table 1.

The steel sheets for hot pressing on which a plating treatment was performed as described above and the steel sheets for hot pressing on which no plating treatment was performed were subjected to hot pressing. Specifically, a test specimen with a size of 100 mm×200 mm was cut from the produced steel sheets for hot pressing, and a heat treatment was performed thereon in an electric furnace. The heat treatment conditions (heating temperature and holding time) are shown in Table 1. The heat-treated test specimen was removed from the electric furnace and was immediately hot-pressed with a hat-shaped die at a forming start temperature of 700° C. In this manner, a hot-pressed member was produced. A shape of the produced hot-pressed member was as follows: a planar portion on an upper side had a length of 100 mm, a planar portion on a lateral side had a length of 50 mm, and a planar portion on a lower side had a length of 50 mm. Furthermore, in the die, both shoulders of an upper side and both shoulders of a lower side all had a bend radius of 7R.

A test specimen with a size of 70 mm×150 mm was cut from the planar portion on the upper side of the produced hot-pressed member, and the surface geometric shapes (the filtered centerline waviness Wca, the line roughness Ra, and the skewness Rsk), post-coating image clarity, and post-coating corrosion resistance were evaluated. Note that in the case of the uncoated steel sheets, Nos. 23 and 24, the surface roughness was measured after an iron scale was removed by shot blasting, and subsequently, the coating application was performed.

The evaluations of post-coating image clarity and post-coating corrosion resistance were performed on coated members, which were prepared by performing a zinc phosphate-based chemical conversion treatment on the test specimens and applying an electrodeposition coating and intermediate and top coatings thereto. The zinc phosphate-based chemical conversion treatment was performed with a PB-SX35, manufactured by Nihon Parkerizing Co., Ltd., under standard conditions, and the electrodeposition coating was performed with a cationic electrodeposition coating material Electron GT-100, manufactured by Kansai Paint Co., in a manner such that the coating had a film thickness of 15 μm. The baking conditions used included a holding temperature of 170° C. and a holding time of 20 minutes. In addition, the intermediate coating (TP-65-P, manufactured by Kansai Paint Co.) and the top coating (Neoaramic 6000-4) were applied thereto in a manner such that the total thickness, including the thickness of the electrodeposition coating, became 80 μm, and the resultant was subjected to the evaluations of post-coating image clarity and post-coating corrosion resistance.

<Measurement of Surface Geometric Shapes>

The surface geometric shapes (the filtered centerline waviness Wca, the line roughness Ra, and the skewness Rsk) were measured in accordance with JIS B 0601, with a Surfcom 1500 SD3, manufactured by Tokyo Seimitsu Co., Ltd. For the hot-pressed member, the measurement of the surface geometric shapes was performed on the surface to which the intermediate coating and the top coating were to be applied. In an instance where the intermediate coating and the top coating were to be applied to both surfaces, the measurement was performed on both the surfaces. For the steel sheet for hot pressing, the measurement was performed on the surface to which the intermediate coating and the top coating were to be applied after hot pressing. In an instance where the intermediate coating and the top coating were to be applied to both surfaces, the measurement was performed on both the surfaces.

<Measurement of Post-Coating Image Clarity>

Post-coating image clarity was measured with a Wavescan Dual Plus, manufactured by BYK-Gardener, and evaluated by using Wavescan DOI as an index. A rating was performed according to the following criteria based on the values of Wa, Wb, Wc, Wd, and We, which correspond to respective wavelength regions in a range of 0.1 to 30 mm. "◎", "○", and "Δ" indicate "pass", and "x" indicates "fail". The evaluation results are shown in Table 1.

◎ (pass, excellent): All of Wa, Wb, Wc, Wd, and We were less than 15, and the difference between the maximum and the minimum of the values was less than 5.

○ (pass, better): All of Wa, Wb, Wc, Wd, and We were less than 15, and the difference between the maximum and the minimum of the values was 5 or greater.

Δ (pass): The maximum value of the values of Wa, Wb, Wc, Wd, and We was 15 or greater and less than 20.

x (fail): The maximum value of the values of Wa, Wb, Wc, Wd, and We was 20 or greater.

<Post-Coating Corrosion Resistance>

A hot-pressed member treated with a zinc phosphate-based chemical conversion treatment and to which an electrodeposition coating and a 3-coat coating were applied was subjected to a corrosion test (SAE-J2334) and evaluated for a corrosion state after 120 cycles. A maximum one-side blistering width from a cross cut was measured, and a rating was performed according to the following criteria. "◎", "○", and "Δ" indicate "pass", and "x" indicates "fail". The evaluation results are shown in Table 1.

◎ (pass, excellent): Maximum one-side blistering width<1.5 mm

○(pass, better): 1.5 mm≤maximum one-side blistering width<3.0 mm

Δ (pass): 3.0 mm≤maximum one-side blistering width<4.0 mm x (fail): 4.0 mm≤maximum one-side blistering width

TABLE 1

| | Steel sheet for hot pressing | | | | | | Heat treatment conditions | | Hot-pressed member | | | | Evaluations | | |
|---|---|---|---|---|---|---|---|---|---|---|---|---|---|---|---|
| | Plating | | Roughness Ra (μm) | Waviness Wca (μm) | Cracks | | Heating temperature (° C.) | Holding time (s) | Plating | Roughness Ra (μm) | Waviness Wca (μm) | Skewness Rsk | Post-coating image clarity | Post-coating corrosion resistance | |
| Level | Components (mass %) | Thickness (μm) | | | Method for introduction | Number density ($mm^{-1}$) | | | Thickness (μm) | | | | | | Notes |
| 1 | Al-10% Si | 20 | 0.9 | 0.2 | — | — | 900 | 120 | 30 | 1.7 | 0.5 | 0.5 | ◎ | ○ | Invention Example |
| 2 | Al-10% Si | 20 | 0.9 | 0.6 | — | — | 900 | 120 | 30 | 1.7 | 1.3 | 1.3 | Δ | ○ | Invention Example |
| 3 | Al-10% Si | 20 | 0.9 | 1.0 | — | — | 900 | 120 | 30 | 1.7 | 2.0 | 2.0 | x | ○ | Comparative Example |
| 4 | Al-10% Si | 20 | 0.9 | 0.7 | Tensile working | 40 | 900 | 120 | 30 | 1.5 | 1.3 | −0.5 | ◎ | ○ | Invention Example |
| 5 | Al-10% Si-1% Mg | 20 | 0.9 | 0.2 | — | — | 900 | 120 | 30 | 1.8 | 0.5 | 0.5 | ◎ | ○ | Invention Example |
| 6 | Al-10% Si-1% Mg | 20 | 0.9 | 0.6 | — | — | 900 | 120 | 30 | 1.8 | 1.3 | 1.3 | Δ | ○ | Invention Example |
| 7 | Al-10% Si-1% Mg | 20 | 0.9 | 1.0 | — | — | 900 | 120 | 30 | 1.8 | 2.0 | 2.0 | × | ○ | Comparative Example |
| 8 | Zn-10% Fe | 10 | 0.9 | 0.2 | — | — | 900 | 60 | 20 | 1.8 | 0.5 | 0.5 | ○ | ○ | Invention Example |
| 9 | Zn-10% Fe | 10 | 0.9 | 0.6 | — | — | 900 | 60 | 20 | 1.8 | 1.3 | 1.3 | Δ | ○ | Invention Example |
| 10 | Zn-10% Fe | 10 | 0.9 | 1.0 | — | — | 900 | 60 | 20 | 1.8 | 2.0 | 2.0 | × | ○ | Comparative Example |
| 11 | Zn-10% Fe | 10 | 0.9 | 0.6 | Tensile working | 40 | 900 | 60 | 20 | 1.5 | 0.7 | −0.5 | ◎ | ◎ | Invention Example |
| 12 | Zn-10% Fe | 10 | 0.9 | 0.6 | Acid dipping | 80 | 900 | 60 | 20 | 1.5 | 0.7 | −0.5 | ◎ | ◎ | Invention Example |
| 13 | Zn-40% Al-2% Si | 20 | 0.9 | 0.2 | — | — | 900 | 120 | 20 | 1.8 | 0.5 | 0.5 | ○ | ○ | Invention Example |
| 14 | Zn-40% Al-2% Si | 20 | 0.9 | 0.6 | — | — | 900 | 120 | 20 | 1.8 | 1.3 | 1.3 | Δ | ○ | Invention Example |
| 15 | Zn-40% Al-2% Si | 20 | 0.9 | 1.0 | — | — | 900 | 120 | 20 | 1.8 | 2.0 | 2.0 | × | ○ | Comparative Example |
| 16 | Zn-40% Al-2% Si-2% Mg | 20 | 1.1 | 0.2 | — | — | 900 | 120 | 20 | 2.1 | 0.5 | 0.5 | ◎ | ○ | Invention Example |
| 17 | Zn-40% Al-2% Si-2% Mg | 20 | 1.1 | 0.6 | — | — | 900 | 120 | 20 | 2.1 | 1.3 | 1.3 | Δ | ○ | Invention Example |
| 18 | Zn-40% Al-2% Si-2% Mg | 20 | 1.1 | 1.0 | — | — | 900 | 120 | 20 | 2.1 | 2.0 | 2.0 | x | ○ | Comparative Example |
| 19 | Zn-12% Ni | 10 | 1.5 | 0.2 | — | — | 900 | 30 | 20 | 3.0 | 0.5 | 0.5 | ○ | ○ | Invention Example |
| 20 | Zn-12% Ni | 10 | 1.5 | 0.6 | — | — | 900 | 30 | 20 | 3.0 | 1.3 | 1.3 | Δ | ○ | Invention Example |
| 21 | Zn-12% Ni | 10 | 1.5 | 1.0 | — | — | 900 | 30 | 20 | 3.0 | 2.0 | 2.0 | × | ○ | Comparative Example |

TABLE 1-continued

| | Steel sheet for hot pressing | | | | | | Heat treatment conditions | | Hot-pressed member | | | | Evaluations | | |
|---|---|---|---|---|---|---|---|---|---|---|---|---|---|---|---|
| | Plating | | Rough- | Wavi- | Cracks | | Heating | | | | | | | Post-coating | |
| Level | Components (mass %) | Thick-ness (μm) | ness Ra (μm) | ness Wca (μm) | Method for intro-duction | Number density ($mm^{-1}$) | tem-per-ature (° C.) | Hold-ing time (s) | Plating Thick-ness (μm) | Rough-ness Ra (μm) | Wavi-ness Wca (μm) | Skew-ness Rsk | Post-coating image clarity | corro-sion resis-tance | Notes |
| 22 | Zn-12% Ni | 10 | 1.5 | 0.2 | Acid dipping | 80 | 900 | 30 | 20 | 1.8 | 0.5 | −0.5 | ◎ | ◎ | Invention Example |
| 23 | Un-plated steel sheet | 0 | 0.1 | 0.2 | — | — | 900 | 30 | 0 | 0.2 | 0.2 | 0.1 | ◎ | Δ | Invention Example |
| 24 | Un-plated steel sheet | 0 | 0.3 | 0.6 | — | — | 900 | 30 | 0 | 0.6 | 0.6 | 0.1 | ○ | Δ | Invention Example |

"—" indicates no treatment was performed.

The results shown in Table 1 demonstrate that the hot-pressed members according to aspects of the present invention had excellent post-coating image clarity and post-coating corrosion resistance. Furthermore, the coated members in which a hot-pressed member according to aspects of the present invention was used as a base member had excellent post-coating image clarity and post-coating corrosion resistance. In addition, the hot-pressed members produced from a steel sheet for hot pressing according to aspects of the present invention had excellent post-coating image clarity and post-coating corrosion resistance.

The invention claimed is:

1. A hot-pressed member comprising at least one surface that has a filtered centerline waviness Wca of less than or equal to 1.5 μm, and further comprising a plated layer disposed on the at least one surface, the plated layer having a thickness of 10 to 80 μm, the plated layer having a composition consisting of Al and one or more further elements selected from the group consisting of Si and Mg.

2. The hot-pressed member according to claim 1, wherein the at least one surface has a line roughness Ra of less than or equal to 2.0 μm and a skewness Rsk of less than or equal to 0.

3. A coated member comprising:

a base member that comprises the hot-pressed member according to claim 1; and a coating layer disposed on at least one surface of the base member and having a thickness of greater than or equal to 15 μm.

4. A coated member comprising:

a base member that comprises the hot-pressed member according to claim 2; and a coating layer disposed on at least one surface of the base member and having a thickness of greater than or equal to 15 μm.

5. A method for manufacturing the hot-pressed member according to claim 1, the method comprising:

heating a steel sheet for hot pressing to a temperature range of an $Ac_3$ transformation temperature to 1000° C., the steel sheet for hot pressing having at least one surface that has a filtered centerline waviness Wca of less than or equal to 0.75 μm; and subsequently hot-pressing the steel sheet for hot pressing.

6. A method for manufacturing the coated member according to claim 3, the method comprising:

heating a steel sheet for hot pressing to a temperature range of an Acs transformation temperature to 1000° C., the steel sheet for hot pressing having at least one surface that has a filtered centerline waviness Wca of less than or equal to 0.75 μm;

hot-pressing the steel sheet for hot pressing; and subsequently providing a coating layer having a thickness of greater than or equal to 15 μm.

* * * * *